US007196973B2

(12) United States Patent
Born et al.

(10) Patent No.: US 7,196,973 B2
(45) Date of Patent: Mar. 27, 2007

(54) METHOD AND DEVICE FOR DISPLAYING A MOON IMAGE CYCLE, IN PARTICULAR FOR A WATCH

(75) Inventors: Jean-Jacques Born, Morges (CH); Frédéric Meylan, Neuchâtel (CH)

(73) Assignee: Asulab S.A., Marin (CH)

( * ) Notice: Subject to any disclaimer, the term of this patent is extended or adjusted under 35 U.S.C. 154(b) by 81 days.

(21) Appl. No.: 11/176,421

(22) Filed: Jul. 8, 2005

(65) Prior Publication Data

US 2006/0007787 A1 Jan. 12, 2006

(30) Foreign Application Priority Data

Jul. 8, 2004 (EP) ..... 04016085

(51) Int. Cl.
*G04B 19/26* (2006.01)

(52) U.S. Cl. ..... 368/18; 368/15; 368/16

(58) Field of Classification Search ..... 368/15–20
See application file for complete search history.

(56) References Cited

U.S. PATENT DOCUMENTS

| | | | | |
|---|---|---|---|---|
| 508,467 | A | 11/1893 | Clark | |
| 4,853,908 | A * | 8/1989 | Bourquin et al. | 368/19 |
| 4,881,213 | A * | 11/1989 | Zaslawsky | 368/15 |
| 6,885,614 | B2 * | 4/2005 | Rey-Mermet | 368/16 |
| 2004/0156269 | A1 * | 8/2004 | Plange et al. | 368/17 |

FOREIGN PATENT DOCUMENTS

| | | |
|---|---|---|
| CH | 598 638 | 5/1978 |
| CH | 688 171 A3 | 6/1997 |
| FR | 2 833 721 A1 | 6/2003 |
| JP | 60-60580 | 8/1985 |

OTHER PUBLICATIONS

Search report in corresponding European patent application No. 04 01 6085, completed Jan. 24, 2005.

* cited by examiner

*Primary Examiner*—Vit Miska
*Assistant Examiner*—Thanh S. Phan
(74) *Attorney, Agent, or Firm*—Griffin & Szipl, P.C.

(57) ABSTRACT

In order to display images true to the real appearance of the moon during a lunation, particularly in a watch, there is provided a rotating indicator disc (8) arranged behind a circular aperture of a dial and comprising an annular region (20) subdivided into alternatively light (21–25) and dark (26–30) fields by lines of separation (31–40) having different shapes, which can appear in succession in the aperture. The drive means impart primary movements on the indicator disc (8), each of which is large enough to replace one of the lines of separation by another in the aperture, and smaller secondary movements, to produce small movements of the line of separation inside the aperture. This allows a new image of the moon to be given every day, true to reality, with a restricted number of light and dark fields on the indicator disc and a particularly large aperture in relation to the size of the dial. A version with electric driving is disclosed and a version driven by a mechanical watch movement.

17 Claims, 4 Drawing Sheets

METHOD AND DEVICE FOR DISPLAYING A MOON IMAGE CYCLE, IN PARTICULAR FOR A WATCH

This application claims priority from European Patent Application No. 04016085.5 filed Jul. 8, 2004, the entire disclosure of which is incorporated herein by reference.

BACKGROUND OF THE INVENTION

The present invention concerns a method for displaying a cycle of successive images of the moon during a lunation in a circular aperture of a dial by means of a mobile indicator arranged behind the aperture and having, on the face thereof that appears in the aperture, lines of separation of different shapes between light fields and dark fields for showing respectively the illuminated part and the dark part of the moon seen from the earth.

The invention also concerns a device for displaying a cycle of successive images of the moon during a lunation in a circular aperture of a dial, particularly for implementing the aforementioned method, comprising a mobile indicator arranged behind said aperture and driving means for moving the indicator step by step so that different parts of one strip-shaped region of the indicator can be seen in succession in the aperture. The invention further concerns a watch comprising a watch movement and this type of display device, whose drive means are controlled by the watch movement.

In conventional devices displaying the phases of the moon, a disc bearing two images of the full moon makes a half revolution per lunation behind a semi-circular aperture of a particular shape, illustrated for example in U.S. Pat. No. 508,467. One of the edges of the aperture comprises two convex arcs which go over the image of the full moon, respectively while the moon is waxing and waning. The shape of the image thus displayed is correct only at the start and at the end of the lunation (starting from the new moon), when the illuminated part has the shape of a crescent, and at full moon. During the other phases, the image displayed has an incorrect shape, since the shape of the line of separation between the light zone and the dark zone is not true to reality: it is curved instead of being straight at the first and last quarter, and it is curved in the wrong direction between the first and the last quarter. In other words, this display mode gives an image of the moon that is not true to reality for most of the lunation.

CH Patent No. 598 638 provides a method and a display device of the type indicated in the preamble hereinbefore, using a circular aperture in front of a disc which rotates through one step every two days about the axis of the hands of a watch and which, in this case, carries a series of fifteen successive images of the lunar disc as it is seen in the sky during the lunation. In practice, the space required for each image and the need to prevent the edge of a second image being seen in the aperture mean that the diameter of the aperture and the image has to be less than approximately one seventh of the diameter of the disc, thus particularly small on a wristwatch dial. These images conform better to reality than those of conventional devices, but their evolution remains quite inaccurate, since the display only changes approximately every two days. If one desired more frequent updating, the number of images on the disc would have to be doubled and their size thus reduced so much that the display would lose all appeal.

SUMMARY OF THE INVENTION

The present invention concerns a method and a device for displaying lunar phases avoiding, to a large extent, the drawbacks of the prior art and showing, in a circular aperture, an image of the illuminated zone and the dark zone of the moon which is as close as possible to reality, and particularly is much truer to reality than the conventional type displays.

Additionally, the invention concerns a method and a device for displaying, in particular in a watch, images of the lunar disc that are both very close to reality each day and relatively large in relation to the watch dial.

Therefore, there is provided a method for displaying a cycle of successive images of the moon during a lunation in a circular aperture of a dial by means of a mobile indicator arranged behind the aperture and having, on the face thereof appearing in the aperture, lines of separation of different shapes between light fields and dark fields, characterised in that:

the display cycle during a lunation is divided into several successive parts at least certain of which comprise several positions of the mobile indicator, which correspond to several successive images formed with different successive positions of the same line of separation visible in the aperture, in order to pass from one part of the cycle to the next part, the mobile indicator is subjected to a primary movement, able to bring a line of separation, that was not yet visible or a field without any line of separation into the aperture, and in each of the parts of the cycle which comprise successive positions of a same line of separation, the mobile indicator is subjected to at least one secondary movement smaller than the primary movements, to make the line of separation pass from one of said successive positions to the next. Particular embodiments of the method use a rotating disc for the display, as is common in watches.

There is further provided a device displaying a cycle of successive images of the moon during a lunation in a circular aperture of a dial, particularly for implementing the method defined hereinabove, comprising a mobile indicator arranged behind said aperture and drive means for moving the indicator such that various parts of a strip-shaped region of the indicator can be successively seen in the aperture, characterised in that said strip-shaped region of the indicator is subdivided in its length into successive fields that are alternately light and dark by lines of separation having different shapes, including at least two rectilinear lines, concave lines on the side of a light field and convex lines on the side of a light field, and in that the drive means are capable of imparting primary movements on the indicator, and secondary movements smaller than the primary movements and able to move one of said lines of separation inside the aperture.

It will be noted that a basic idea of the present invention consists in using the same line of separation, located on the mobile indicator, for form different successive images of the moon by slightly moving this line to pass to the next image. This is how it becomes possible to reduce the number of lines of separation in relation to the number of different images that one wishes to display, and thus reduce the number of light and dark fields on the indicator. Consequently, the fields and the aperture allowing them to appear can be relatively large in relation to the size of the indicator and that of the dial.

DETAILED DESCRIPTION OF VARIOUS EMBODIMENTS

Figure 1:
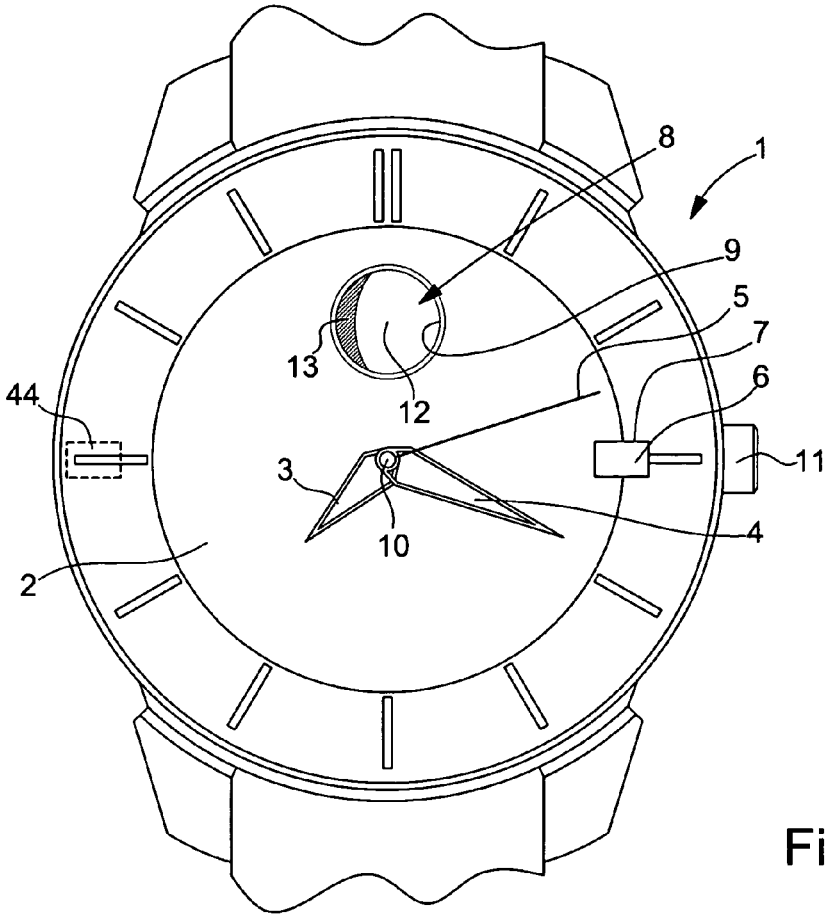
FIG. 1 is a view of the top face of a wristwatch comprising a moon phase display according to the present invention.

FIG. 1 shows a wristwatch 1 having, on a fixed dial 2, an analogue time display by means of hour hand 3, minute hand 4 and second hand 5. Moreover, there is provided a date display by means of a date disc 6 appearing in an aperture 7 of the dial, and a moon phase display by means of a moon indicator disc 8 appearing in a circular aperture 9 of dial 2. In this example, the two discs 6 and 8 are concentric and both rotate about the axis of rotation 10 of the hands, preferably located at the centre of the dial, and they can be located in the same plane behind the dial, disc 6 being annular as usual. The functions of the watch are controlled by means of a crown 11 of known type.

In a first embodiment which will now be described with reference to FIGS. 1 to 3, watch 1 is a multifunction electronic watch and its display members are actuated by means of electric stepping motors. In particular, moon indicator disc 8 is provided with a drive mechanism (not shown) having its own stepping motor, with a reducing gear large enough that, for example, about 1000 steps of the motor are necessary to produce one complete revolution of disc 8. Date disc 6 is driven by means of a motor that is dedicated thereto, whereas hands 3 to 5 can be driven by means of one or several other motors.

In aperture 9, the user of the watch sees a circular portion of disc 8, which shows the current appearance of the moon seen from the earth and comprises, most of time, a light part 12 and a dark part 13 respectively showing the illuminated part and the non-illuminated part of the moon. Parts 12 and 13 are delimited by a line of separation that can be rectilinear or more or less curved depending upon the age of the moon, whereas no line of separation is visible at the new moon and at full moon.

Figure 2:
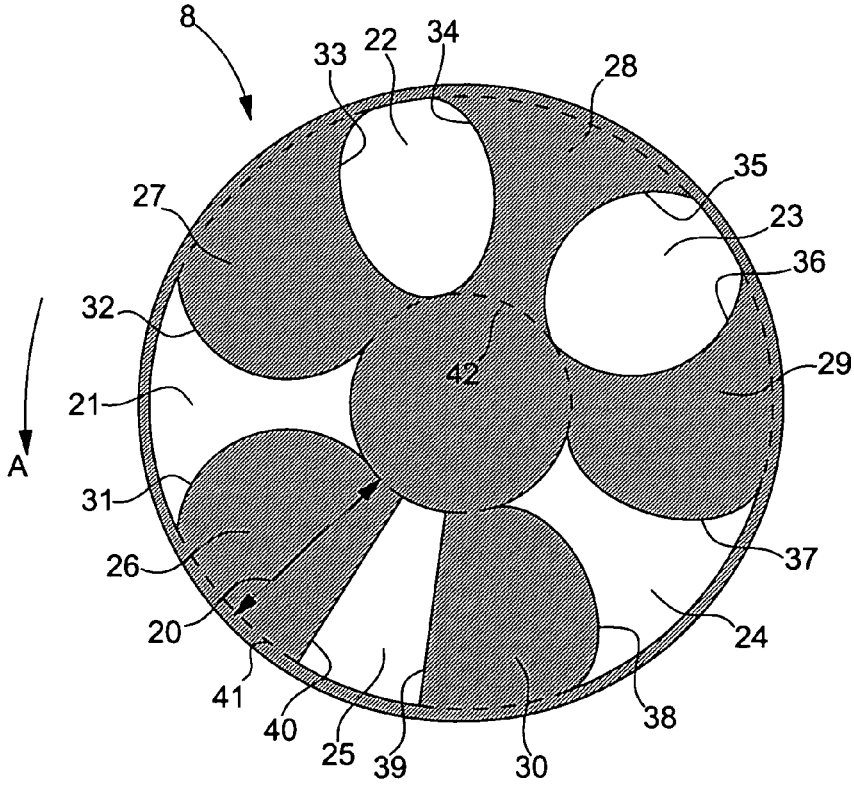
FIG. 2 shows the top face of a moon indicator disc of the watch of FIG. 1, in an embodiment in which the disc is driven by means of an electric motor.

FIG. 2 shows a preferred arrangement of the top face of disc 8 in the first embodiment of the invention. A region 20 in the form of an annular strip, whose width in a radial direction is slightly greater than the diameter of aperture 9 of the dial, is subdivided in its circumference into successive alternatively light and dark fields, namely five light fields 21 to 25 and five dark fields 26 to 30, owing to five pairs of lines of separation, both lines of separation of each pair being symmetrical with each other. Light field 21 is separated from the adjacent dark fields 26 and 27 by two lines of separation 31 and 32 with a strong convex curve on the light side, their respective directions of curvature being opposite. Likewise, light field 22 is separated from the adjacent dark fields 27 and 28 by two lines of separation 33 and 34 with a slight concave curve on the light side, the light field 23 is separated from the adjacent dark fields 28 and 29 by two lines of separation 35 and 36 with a strong concave curve on the light side, light field 24 is separated from the adjacent dark fields 29 and 30 by two lines of separation 37 and 38 with a slight convex curve on the light side, and finally light field 25 is separated from the adjacent dark fields 30 and 26 by two rectilinear lines of separation 39 and 40. Circles 41 and 42 drawn in FIG. 2 are used only to show the notion of a strip comprising light and dark fields, but they are not really drawn on disc 8.

It should be noted that the lines with a relatively slight curve 33, 34, 37 and 38 are preferably elliptical, to give an image that is as true as possible to reality, whereas the lines with a relatively large curve 31, 32, 35 and 36 can have an elliptical or other shape, for example circular, without altering the image of the moon. It should also be noted that lines 31 and 36 have the same shape, the concavity being found on the side of a light field in one case and on the side of a dark field in the other case. The same is obviously true for lines 32 and 35, 33 and 38, 34 and 37. Thus, counting also the rectilinear shape of lines 39 and 40, this first embodiment uses only five different shapes for the lines of separation.

The fact that annular strip 20 of disc 8 only comprises five light fields and five dark fields and that several of these fields occupy, in the direction of the circumference, a length less than the diameter of circular aperture 9, constitutes a considerable advantage, because the ratio between the diameter of the aperture and that of the moon indicator disc can be much larger than according to the prior art illustrated by CH Patent No. 598 638 mentioned in the introduction. This ratio can attain approximately 1:3.6 with the arrangement according to FIG. 2. In other words, the invention offers the possibility of displaying a relatively large image of the moon, while varying this image often enough for it to still conform to reality.

Each of lines of separation 31 to 40 is used during a given phase of the lunation, the direction and size of its curvature being determined as a function of the appearance of the moon seen from the earth during that phase, i.e. essentially the general shape of the illuminated part of the moon.

Figure 3:
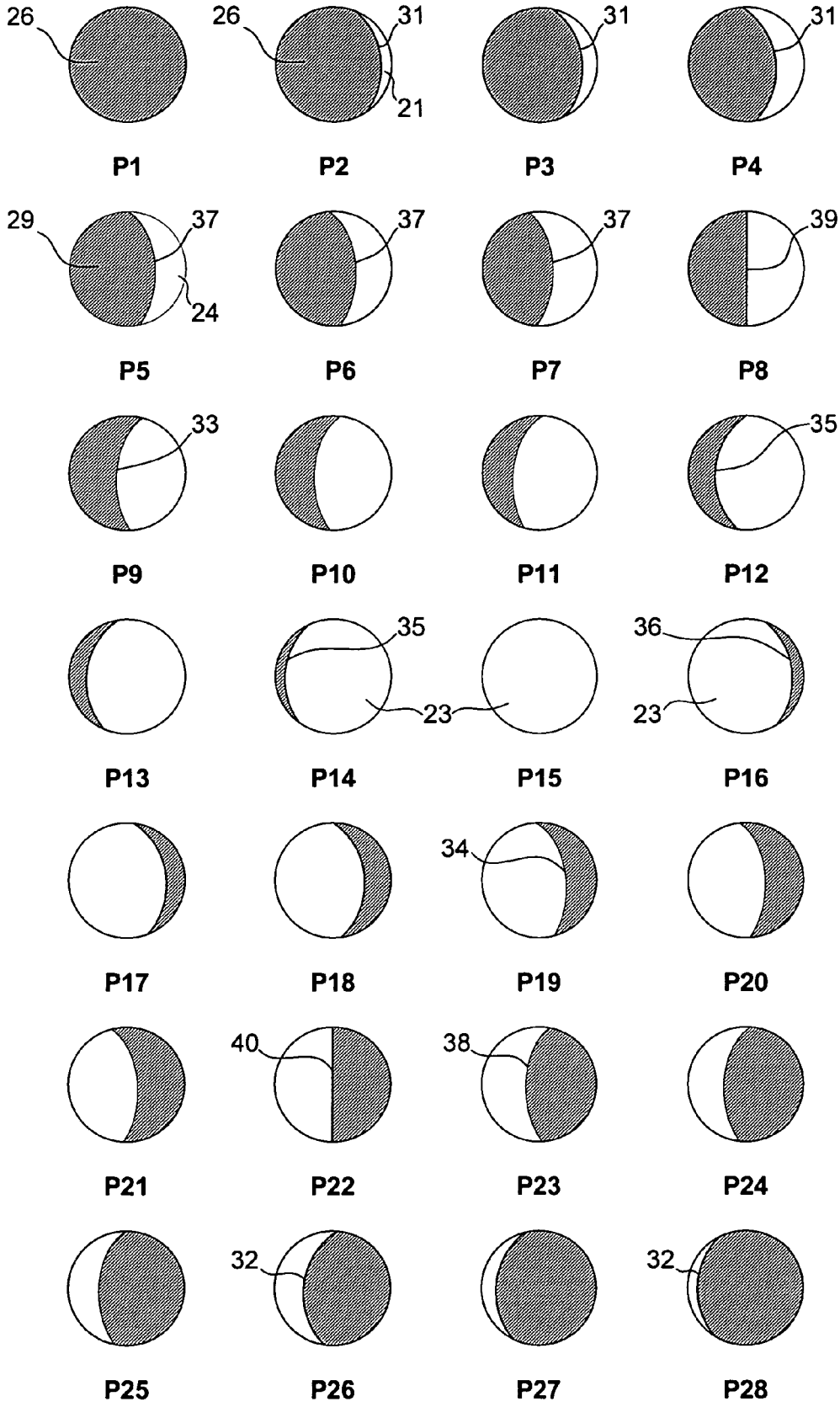
FIG. 3 shows twenty-eight images of the moon that the disc of FIG. 2 is capable of displaying.

FIG. 3 shows twenty-eight different images of the moon, that disc 8 can show in round aperture 9 of the dial in successive positions P1 to P28. This is a non-limiting example, since disc 8 is capable of displaying at will a larger number of different images. A number of positions and images that can be divided by four will preferably be chosen in order to display the same number of images in each quarter of a lunation. However, it will be seen hereinafter that the electronic circuit can be programmed in a way that varies this number. In order to pass from one position to the next, disc 8 either makes a relatively small rotation, called a secondary rotation, having the effect of slightly moving the line of separation appearing in aperture 9, or a relatively large rotation, called a primary rotation, to bring one or two new fields and/or a new line of separation opposite aperture 9 or at the edge thereof. Typically, the primary rotations are greater than or equal to approximately 45 degrees, while the secondary rotations are of the order of 1 to 4 degrees, depending upon the number of positions and the number of lines of separation on the disc.

The position P1 represents the new moon showing only dark field 26 in the aperture, then a small (secondary) rotation of disc 8 in the direction of arrow A makes line of separation 31 appear in the aperture and a little of light field 21 to show a slender crescent of moon in position P2. The following positions P3 and P4 are reached each time by a small additional rotation of disc 8 in the direction of A. Beyond this, the curvature of line 31 would be too great in relation to the real appearance of the moon. This is why separation line 37, which has an elliptical shape and has less curvature in its median part than line 31, will be used in a second part of the lunation. In order to pass from P4 to P5, the electronic circuits of the watch control the electric motor such that it makes a large number of steps to produce a large (primary) rotation of disc 8, either in the direction of A, or in the opposite direction, bringing line 37 and fields 24 and 29 into position P5 opposite aperture 9. Subsequently, line 37 is moved forward by a secondary rotation to position P6, then to position P7. In order to obtain the next position P8 which represents the moon in the first quarter, rectilinear line of separation 39 is brought into the aperture by a primary rotation of disc 8. Line 39 is then replaced in the aperture by line 33 with a slight concave curve at position P9, and then two secondary rotations of disc 8 bring line 33 in succession to positions P10 and P11. A primary rotation then replaces line 33 with line 35 with a greater curvature for position P12. The following secondary rotations of disc 8 in the direction of A first of all bring line 35 in succession to positions P13 and P14, then move this line out of aperture 9, where one can only see light field 23 to represent the full moon in position P15. The next second rotations of the disc cause line of separation 36, located on the other side of field 23, to appear in the aperture, in succession into positions P16, P17 and P18. A primary rotation then replaces line 36 with line 34 with a smaller curvature for position P19. The next secondary rotations of disc 8 in the direction of A first of all bring line 34 in succession into positions P20 and P21, then a primary rotation replaces this line with rectilinear line 40 to show the moon in the last quarter in position P22. Line 40 is then replaced in the aperture at position P23 by line 38 with a small concave curvature, and then two secondary rotations of disc 8 bring line 38 in succession to positions P24 and P25. A primary rotation then replaces line 38 with line 32 with a greater curvature for position P26. The following secondary rotations of disc 8 in the direction of A bring line 32 in succession to positions P27 and P28, then a primary rotation causes this line to move out of aperture 9 and dark field 26 to appear to show the new moon in position P1, such that the moon image display cycle starts again.

In summary, the moon image display cycle during a lunation is thus divided into ten unequal parts, as shown by the following table.

| Part no. | Positions | Line of separation |
|---|---|---|
| I | P1–P4 | 31 |
| II | P5–P7 | 37 |
| III | P8 | 39 |
| IV | P9–P11 | 33 |
| V | P12–P14 | 35 |
| VI | P15–P18 | 36 |
| VII | P19–P21 | 34 |
| VIII | P22 | 40 |
| IX | P23–P25 | 38 |
| X | P26–P28 | 32 |

It will be noted in the description that precedes the table that it is possible to pass from part V to part VI of the cycle without any primary rotation, but by a single secondary rotation, if the spacing of lines 35 and 36 is chosen so as to leave between them just enough place for the image of the full moon.

In the example presented here, passage from one of positions P1 to P28 to the next can occur either at a fixed time, or at fixed time intervals corresponding to 1/28 of the mean duration of the synodic lunation, namely approximately 25.312 hours, passage from P1 to P2 being made for example at a half-interval after the instant of the new moon. This instant is drawn from an ephemeris table, which is stored in the electronic perpetual calendar watch. Generally, it will be noted that the electronic circuits of the watch can be programmed to display, particularly by means of disc 8 as shown in FIG. 2, any number of images of the moon during one lunation, by changing image at moments that the watch manufacturer can predetermine freely via an appropriate programme. For example, approximately sixty different positions of the disc can be provided in order to display an image that is true to the real appearance of the moon each evening and each morning.

The electronic watch illustrated by FIGS. 1 to 3 can further be designed to display the age of the moon, i.e. the number of days since the last new moon. A simple method consists in temporarily indicating the age of the moon in aperture 7 by means of date indicator 6 in response to a specific manoeuvre of crown 11. Another watch construction can comprise an additional indicator, for example a similar annular disc to date disc 6 arranged concentrically thereto, to indicate numerically the age of the moon in an additional aperture 44 as shown in dotted lines in FIG. 1.

Figure 4:
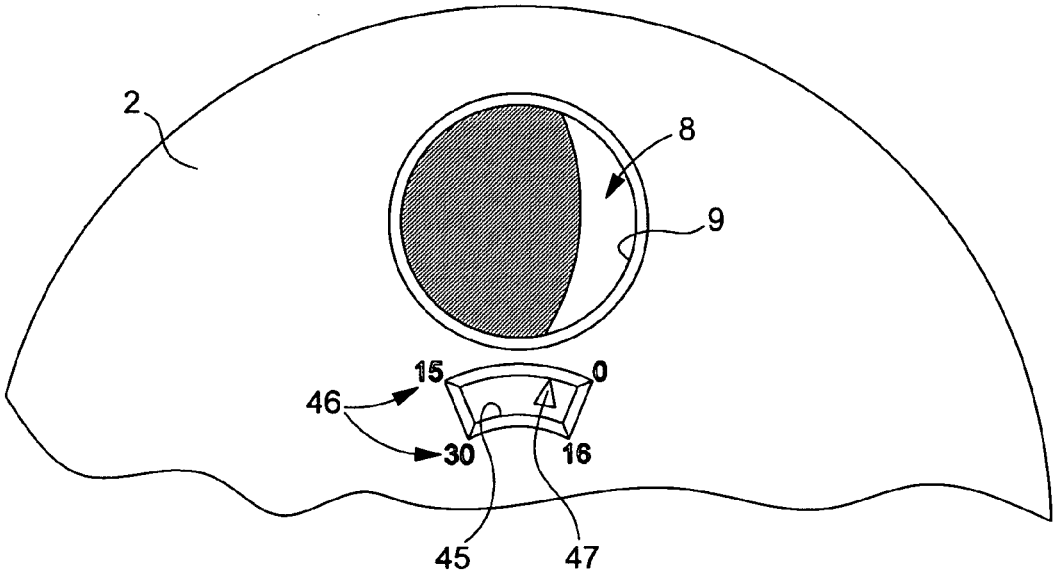
FIG. 4 shows an alteration in the watch dial of FIG. 1, in a second embodiment where the moon indicator disc is driven mechanically from the watch movement.
Figure 5:
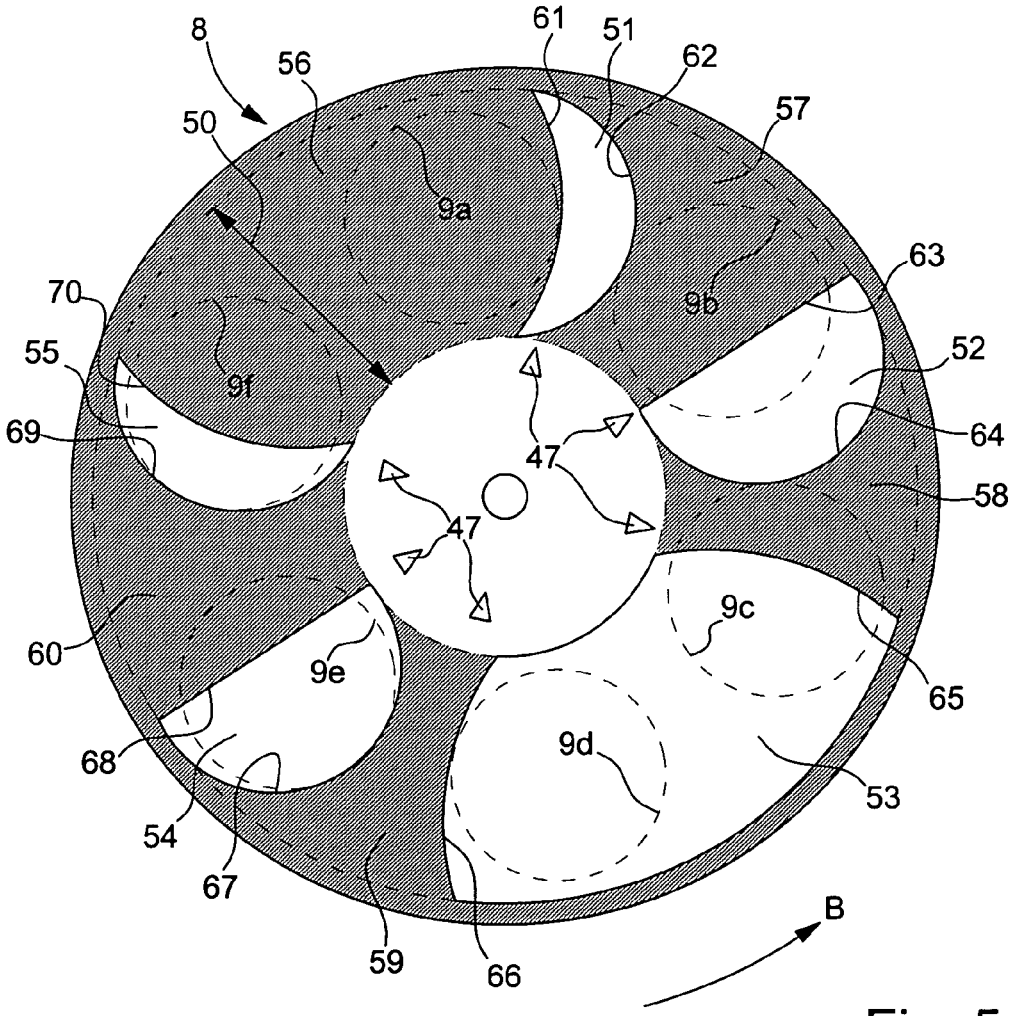
FIG. 5 shows the top face of the moon indicator disc in the second embodiment.

In a second embodiment that will now be described with reference to FIGS. 1 and 4 to 7, watch 1 is a watch with a mechanical movement and the movement drives its display members. In particular, the moon indicator disc 8, whose top face is visible in FIG. 5, is provided with a drive mechanism 75 shown in FIGS. 6 and 7. FIG. 4 shows that there is further provided an indication of the age of the moon. Thus, close to circular aperture 9 which is the same as in FIG. 1, dial 2 comprises an elongated aperture 45 edged with a scale 46 from, for example, 1 to 29 or 30. In order to reduce the length of the aperture, half of scale 46 is distributed over one edge of the aperture, and the other half along the opposite edge. A small zone of disc 8 appears in this aperture and comprises an index 47 which points over the half of scale 46 concerned.

In a similar manner to that of the preceding example, but with a slightly different geometry, there is provided on disc 8 a region 50 in the form of an annular strip, which is subdivided in its circumference into successive, alternatively light and dark fields, namely five light fields 51 to 55 and five dark fields 56 to 60 owing to ten lines of separation 61 to 70. In this case, only lines of separation 61, 63, 65, 66, 68 and 70 will become visible in aperture 9, during six respective parts of the lunation. The layout of each of these lines 62, 64, 67 and 69 is chosen so as to prevent the adjacent dark field to the line appearing while the adjacent light field is visible in the aperture.

In FIG. 5, the six circles 9*a* to 9*f* each represent the relative position of aperture 9 at the start of the corresponding part of the cycle with respect to the light field appearing in the aperture for this part of the cycle. Thus, position 9*a* gives the image of the new moon and it is tangent to line 61 which will appear next in the aperture when disc 8 makes small secondary rotations, following the same principle as in the first embodiment. This line is convex on the side of light field 51. When the other line 62 delimiting field 51 arrives close to the edge of aperture 9, a large primary rotation of disc 8 will bring rectilinear separation line 63 and a part of light field 52 into aperture 9, a situation that is represented by the relative position 9*b* which corresponds to the start of the first quarter phase. Position 9*c* corresponds to the start of the waxing gibbous moon and is associated with line 65 that is concave on the side of light field 53. Position 9*d* corresponds to the full moon phase and it is tangent to line 66, concave on the side of light field 53, which will appear in the aperture next when disc 8 makes small secondary rotations. Position 9*e* represents the start of the last quarter phase and sits on rectilinear line 68. Finally, position 9*f* corresponds to the start of the last part of the lunar cycle and sits on line 70 which is convex on the side of light field 55.

Disc 8 is provided with a series of six indices 47 each of which is associated with six lines of separation 61, 63, 65, 66, 68 and 70 which appear in succession in circular aperture 9. Each index 47 is placed on the disc in an angular position such that it appears in elongated aperture 45 and indicates on scale 46 the correct age of the moon at the moment when a primary rotation brings the line into circular aperture 9. The following secondary rotations will cause the index to advance along the scale, until the next primary rotation brings another line of separation and another index into the apertures. Owing to the small length of aperture 45, indices 47 could be placed on the disc such that only one index is visible at a time in the aperture. It will also be noted that, instead of being located closer to the centre of disc 8 than circular aperture 9, indices 47 and elongated aperture 45 could be situated more towards the exterior, in the region of the periphery of disc 8.

Of course, the moon age indication mode illustrated by FIGS. 4 and 5 can also be used in an electronic watch of the type illustrated by FIGS. 1 to 3.

It should be noted that the lines of separation used have only three different shapes, namely a curved shape with a centre of curvature to the left, when the line is at the top of the drawing, in the case of lines 61 and 66, a curved shape with a centre of curvature to the right in the case of lines 65 and 70, and a rectilinear shape in the case of lines 63 and 68. As in the preceding example, the small number of light fields 51 to 55 distributed in annular strip 50 allow an aperture 9 to be used that occupies quite a large portion of the diameter of disc 8, thus also of dial 2 of watch 1.

Figure 6:
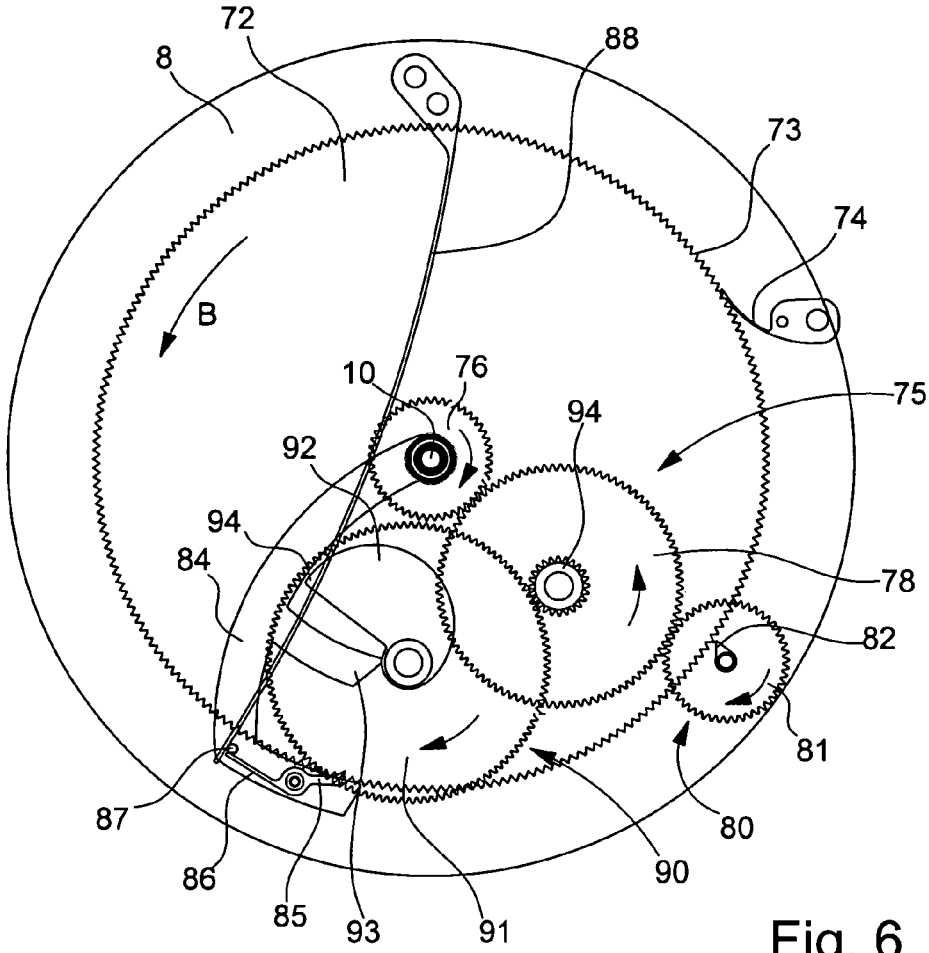
FIG. 6 is a transparent plan view of the disc of FIG. 5 with its drive mechanism.
Figure 7:
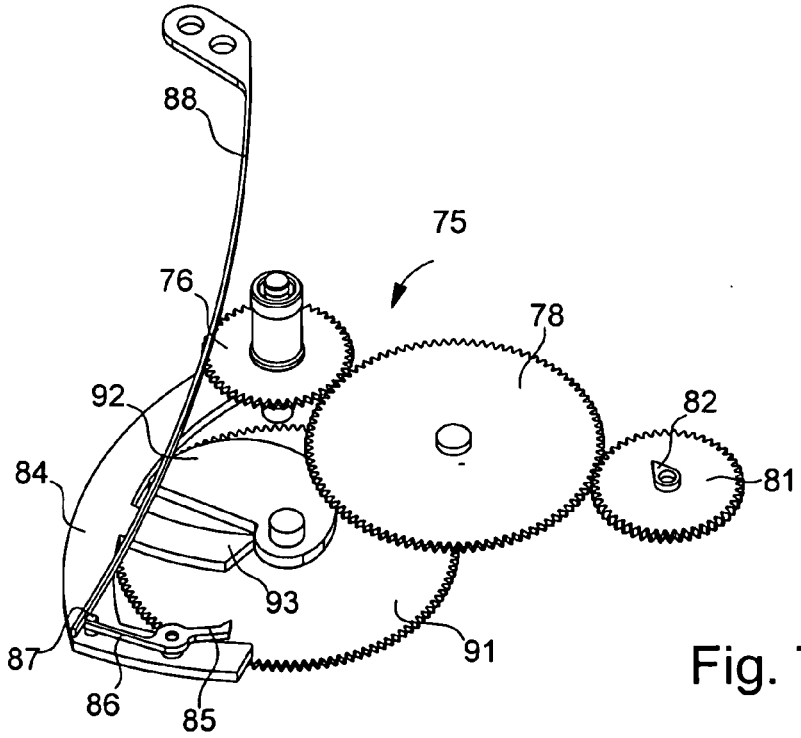
FIG. 7 is a perspective view of the mechanism of FIG. 6.

With reference to FIG. 6, which is a transparent view, it will be noted that moon indicator disc 8 is secured to a moon wheel 72 having an outer toothing 73 with 233 teeth, whose position is maintained by a jumper-spring 74. Wheel 72 and disc 8 are driven in accordance with two different modes from the hour wheel 76 of the mechanical watch movement, by means of a drive mechanism 75 visible in FIGS. 6 and 7. Wheel 76 evidently completes one revolution in twelve hours and drives, via an intermediate wheel 78 completing one revolution per day, a first drive wheel set 80 also completing one revolution in twelve hours and comprising a wheel 81 and a finger 82 which acts on toothing 73 so as to make moon wheel 72 advance by one tooth twice a day in the direction of arrow B. This first drive mode thus produces two secondary rotations of 1/233rd of a revolution per day, i.e. of approximately 1.5 degrees each.

The second drive mode of disc 8 uses an oscillating lever 84 which pivots about axis of rotation 10 of disc 8 of wheel 76 and which carries at its end a click 85 cooperating with toothing 73 via the effect of a spring 86 applied against a stud 87 of lever 84. A stationary spring 88 is also applied against stud 87 to push lever 84 back permanently in the direction of arrow B. A second drive wheel set 90, comprising a wheel 91 and a spiral cam 92 which cooperates with a beak 93 of lever 84, is driven in continuous rotation by wheel 91 meshing with a pinion 94 secured to intermediate wheel 78. Drive wheel set 90 completes an integer number of revolutions per lunation, in this case, six revolutions in 29.5 days, owing to the following numbers of teeth:

| | |
|---|---|
| wheel 76 | 48 teeth |
| wheel 78 | 96 teeth |
| pinion 94 | 24 teeth |
| wheel 91 | 118 teeth |

During each revolution of wheel set 90, cam 92 gradually pushes lever 84 back in the opposite direction to B, then as soon as beak 93 has cleared the outer end 94 of the spiral of the cam, lever 84 abruptly rotates in the direction of B over an angle which is defined by the cam and which corresponds here to 29 teeth of toothing 73. Click 85 of the lever thus imparts to moon wheel 72 and disc 8 a primary rotation of 29/233rds of a revolution or approximately 44.8 degrees at regular intervals of (29.5×24)/6=118 hours. Wheel set 90 can be indexed in relation to wheel set 80 such that finger 82 is no longer meshed with toothing 73 at the moment of the primary rotation.

Consequently, the display cycle corresponding to a lunation comprises 6 primary rotations and 59 secondary rotations of indicator disc 8, thus it shows 65 different images of the moon in aperture 9 of the watch dial. Each of the six parts of the cycle has the same duration of 118 hours and starts with the image represented by one of the positions 9*a* to 9*f* shown in FIG. 5.

In the example described here, the first drive wheel set makes an integer number of revolutions per day, such that each secondary rotation occurs at a fixed time. This condition is not imperative, because the secondary rotation is so small and slow that it is practically not seen at the time, and because this wheel set has to make an integer number of revolutions per lunation, the duration of which is in reality not an integer number of days. In other words, the ratio of the speeds of the two wheel sets 80 and 90 has to be a ratio of integer numbers, whereas the ratio of the driving thereof by the watch movement can be chosen freely in order to best match the real mean duration of a synodic lunation.

The present invention is not limited to the use of a mobile indicator formed by a rotating disc, since any indicator provided with a strip of any shape carrying the light and dark fields can be used insofar as its drive device is capable of making the strip advance behind a circular aperture. For example, such an indicator could be formed by the periphery of a drum, by a flexible endless strip passing over pulleys, or even by an elongated plate moved backwards and forwards.

What is claimed is:

1. A method for displaying a cycle of successive images of the moon during a lunation in a circular aperture of a dial by means of a mobile indicator arranged behind the aperture and having, on the face thereof appearing in the aperture, lines of separation of different shapes between light fields and dark fields, wherein:

the display cycle during a lunation is divided into several successive parts at least certain of which comprise several positions of the mobile indicator, which correspond to several successive images formed with different successive positions of the same line of separation visible in the aperture, in order to pass from one part of the cycle to the next part, the mobile indicator is subjected to a primary movement, able to bring a line of separation that was not yet visible or a field without any line of separation into the aperture, and in each of the parts of the cycle which comprise successive positions of a same line of separation, the mobile indicator is subjected to at least one secondary movement smaller than the primary movements, to make the line of separation pass from one of said successive positions to the next.

2. The method of claim 1, wherein at least twenty-eight movements are made per lunation.

3. The method of claim 1, wherein the mobile indicator is a rotating disc, said movements being rotations about an axis perpendicular to the disc.

4. The method of claim 1, wherein said movements are produced by means of an electric stepping motor and wherein the primary movements have different amplitudes and/or directions.

5. A device displaying a cycle of successive images of the moon during a lunation in a circular aperture of a dial, comprising a mobile indicator arranged behind said aperture and drive means for moving the indicator such that various parts of a strip-shaped region of the indicator can be successively seen in the aperture, wherein said strip-shaped region of the indicator is subdivided in its length into successive fields that are alternately light and dark by lines of separation having different shapes, including at least two rectilinear lines, concave lines on the side of a light field and convex lines on the side of a light field, and wherein the drive means are capable of imparting primary movements on the indicator, and secondary movements smaller than the primary movements and able to move one of said lines of separation inside the aperture.

6. The device of claim 5, wherein each of the primary movements is large enough to replace one of said lines of separation by another inside or at the edge of the aperture.

7. The device of claim 5, wherein the mobile indicator is a circular or annular disc, the strip-shaped region being annular.

8. The device of claim 5, wherein the different shapes of the lines of separation are at most five in number.

9. The device of claim 8, wherein the strip-shaped region comprises five light fields respectively delimited by a pair of rectilinear lines of separation, a pair of concave lines of separation with a relatively slight curvature, a pair of concave lines of separation with a relatively large curvature, a pair of convex lines of separation with a relatively slight curvature and a pair of convex lines of separation with a relatively large curvature.

10. The device of claim 5, wherein it further includes means indicating the age of the moon, comprising in the dial an elongated aperture, edged with a scale, and on the mobile indicator a series of indices each arranged in correspondence with one of the lines of separation which appear in the circular aperture, so that a single index is visible at a time in the elongated aperture facing the scale.

11. A watch including a watch movement and the display device of claim 5 whose drive means are controlled by said watch movement.

12. The watch of claim 11, wherein each of the primary movements is large enough to replace one of said lines of separation by another inside or at the edge of the aperture.

13. The watch of claim 11, wherein the mobile indicator is a circular or annular disc, the strip-shaped region being annular.

14. The watch of claim 11, wherein the different shapes of the lines of separation are at most five in number.

15. The watch of claim 11, wherein said watch movement is an electronic movement and wherein said drive means include an electric stepping motor.

16. The watch of claim 11, wherein said mobile indicator is a circular or annular disc, wherein said watch movement is a mechanical movement and wherein said drive means include:

a moon wheel mechanically connected to the mobile indicator and provided with a toothing, a first drive mobile which is driven in rotation by the watch movement and arranged to impart one or several secondary rotations on the moon wheel per day, a second drive mobile, which is driven in rotation by the watch movement so as to make an integer number of revolutions per lunation and which includes a spiral cam, and a lever capable of pivoting about the same axis as the moon wheel and provided with a click cooperating with the toothing of the moon wheel, said lever being controlled by the spiral cam so as to make, during each lunation, an integer number of back and forth angular movements each of which, by means of a click, causes a primary rotation, greater than each secondary rotation, of the moon wheel.

17. The watch of claim 16, wherein said toothing of the moon wheel has 233 teeth, the first drive mobile makes the moon wheel advance by 59 teeth per lunation, and the second drive mobile makes 6 revolutions per lunation, each of which produces a back and forth movement of the lever which causes the moon wheel to advance by 29 teeth.

* * * * *